US005863120A

United States Patent [19]

Gallagher et al.

[11] Patent Number: 5,863,120

[45] Date of Patent: Jan. 26, 1999

[54] MEDIUM CONSISTENCY LIQUID MIXTURE

[75] Inventors: Brian J. Gallagher, Litchfield; Christopher J. LaRiviere, Milford; Maurice P. Bedard, Goffstown, all of N.H.

[73] Assignee: Beloit Technologies, Inc., Wilmington, Del.

[21] Appl. No.: 792,548

[22] Filed: Jan. 31, 1997

[51] Int. Cl.[6] ..... B01F 5/04

[52] U.S. Cl. ..... 366/171.1; 366/172.2; 366/305

[58] Field of Search ..... 366/102, 168.1, 366/171.1, 172.1, 172.2, 174.1, 178.1, 178.3, 181.4, 184, 262–266, 302, 305, 307, 318; 162/57, 243

[56] References Cited

U.S. PATENT DOCUMENTS

| | | | |
|---|---|---|---|
| 2,591,966 | 4/1952 | Rider | 366/305 |
| 2,798,698 | 7/1957 | Dooley | 366/171.1 |
| 2,960,318 | 11/1960 | Cailaud | 366/171.1 |
| 3,051,455 | 8/1962 | Magester | 366/172.1 |
| 3,284,055 | 11/1966 | Johansen . | |
| 3,744,763 | 7/1973 | Schnoring et al. | 366/178.1 |
| 4,099,267 | 7/1978 | King | 366/172.1 |
| 4,295,925 | 10/1981 | Bentvelzen et al. . | |
| 4,339,206 | 7/1982 | Ahs | 366/307 |
| 4,416,548 | 11/1983 | Carre et al. | 366/171.1 |
| 4,612,088 | 9/1986 | Nardi . | |
| 4,820,381 | 4/1989 | Brown . | |
| 4,834,547 | 5/1989 | Niskanen . | |
| 4,877,368 | 10/1989 | Timperi et al. . | |
| 4,908,101 | 3/1990 | Frisk et al. | 366/307 |
| 4,915,509 | 4/1990 | Sauer et al. | 366/171.1 |
| 5,607,233 | 3/1997 | Yant et al. | 366/307 |
| 5,725,306 | 3/1998 | Kappel et al. | 366/172.2 |

FOREIGN PATENT DOCUMENTS

| | | |
|---|---|---|
| WO 96/30587 | 10/1996 | WIPO . |
| WO 97/46310 | 12/1997 | WIPO . |

OTHER PUBLICATIONS

PCT Search Report–06–01–1998.

*Primary Examiner*—Charles E. Cooley
*Attorney, Agent, or Firm*—Lathop & Clark

[57] ABSTRACT

A rotor shaft extends axially through an interior cylinder defined by a housing. The shaft is mounted for rotation at one end. A flow of medium consistency stock is introduced axially to the cylinder, while a chemical inlet supplies bleaching chemicals axially to a rotor mounted on the shaft. The head of the rotor has turbine passages which accelerate the impinging bleaching chemicals along radial lines to be thus distributed across the whole aperture of the cylinder. Tapered vanes extend from the rotor adjacent to the rotor head and create circulating vortices which mix the bleach chemicals with the pulp. As the tapered vanes extend radially toward the cylindrical walls of the cylindrical housing, the vortices extend to the housing walls. The finely mixed bleaching chemicals and pulp are then forced through a foraminous cylinder which separates the interior of the cylindrical housing from an outlet volute by vanes which extend to near engagement with the foraminous cylinder. The foraminous cylinder has a porosity of about ten percent, the holes formed in the foraminous being on the order of one inch in diameter. The shear produced between by the radial vanes fluidizes the pulp and completely mixes the bleach chemicals and the pulp.

28 Claims, 3 Drawing Sheets

MEDIUM CONSISTENCY LIQUID MIXTURE

FIELD OF THE INVENTION

The present invention relates to liquid mixers in general and to mixers for dispersing liquids in medium consistency pulp in particular.

BACKGROUND OF THE INVENTION

In the processing of wood to produce paper the wood is reduced to individual fibers. The fibers are produced either by mechanically abrading wood or by chemically processing wood chips to remove the lignin which binds the fibers together in raw wood. The individual fibers are then typically subjected to further mechanical and chemical processing to improve the properties of the fibers and thus produce a better grade of paper.

Recycled fibers are typically freed from recycled paper for fiber board by repulping the recycled material into individual fibers. Again the recycled fiber are subjected to mechanical and chemical processing to clean and improve the properties of the recycled fibers.

Bleaching of the fibers is one very important chemical process to which raw and recycled wood fibers are subjected to lighten and brighten the fibers in order to produce a lighter, more valuable grade of paper. The bleaching of paper pulp today is a complicated, many step process, and can employ numerous bleaching agents, including chlorine, oxygen, ozone, chlorine dioxide and hydrogen peroxide. Many of the bleaching chemicals must be evenly dispersed throughout the mass of fibers, or an undesirable mottled, or uneven, bleaching of the fibers results.

For many of the processes involving wood fibers in the papermaking process, the fibers are handled as so called "medium consistency" stock, consisting of about twelve percent fibers by weight dispersed in eighty-eight percent water by weight. Medium consistency stock contains about the maximum fiber content at which the stock can still be handled as a liquid by pumping. However, medium consistency stock is more like a solid than a liquid, easily holding it's shape if piled on a flat surface. Under normal conditions, medium consistency stock is difficult to mix with any additive.

However, if the medium consistency stock is subjected to high levels of shear, it becomes very fluid, approaching the fluidity of ordinary water, and under the turbulent conditions produced by the high shear levels rapidly mixes. Producing the necessary level of shear in the medium consistency stock requires between five and fifty megawatts per cubic meter, or up to fifty kilowatts per liter of stock. This amount of energy would bring the stock to a boil in about six seconds. In order to keep energy costs to a reasonable level, the volume of fluid flow subjected to high shear must be kept to a minimum. Minimizing the volume subjected to high shear results in the fluids being subjected to the shear for only a small fraction of a second. The problem with using a very small volume for mixing is that the distribution of chemicals and pulp must be uniformly distributed on a scale consistent with the mixing volume which is subjected to high shear.

A number of known devices exist for mixing medium consistency paper pulp stock. For example, U.S. Pat. No. 4,435,085 to Luthi et al., which utilizes a disk-shaped rotor rotating between fixed disks. Another device, U.S. Pat. No. 5,378,321 to Delcourt, discloses mixing between conical rotating surfaces which produce high shear. Yet a further device, disclosed in U.S. Pat. No. 5,466,334 to Fredriksson et al., has a toothed roll rotating within a housing and opposed to a toothed plate. These existing devices mix medium consistency pulp stock by providing regions of high shear where mixing can take place.

However, if improved distribution of the chemicals to be mixed with the pulp could be achieved, a smaller region of high shear could be used with the result that less power would be required for mixing and/or greater uniformity of chemical distribution within the pulp could be achieved.

SUMMARY OF THE INVENTION

The pulp mixer of this invention employs a two step process for distributing chemicals, typically chlorine dioxide or hydrogen peroxide, within medium consistency paper pulp stock. The first step is to achieve distribution of the chemical to be mixed with the pulp throughout the bulk of the pulp on a scale consistent with the region of high shear created by the pulp mixer. The second step is to subject the well-mixed stock to a region of high shear where the stock is fluidized and mixing within the fluidized volume takes place.

The mixer consists of a housing which defines an interior cylinder. An axial shaft extends through the housing cylinder and is mounted for rotation at a first end of the cylinder. The other end of the cylinder is open and receives a flow of medium consistency stock. A chemical inlet pipe supplies bleaching chemicals to a chemical outlet positioned along the axis of the cylinder. The outlet of the pipe is directed towards a rotor mounted on the shaft. The head of the rotor has turbine passages formed in the rotor body which accelerate the bleaching chemicals along radial lines when the bleaching chemicals are directed against the head. This distributes the bleaching chemicals across the whole aperture of the cylinder. Tapered vanes extend from the rotor adjacent to the rotor head and create circulating vortices which mix the bleaching chemicals with the pulp. As the tapered vanes extend radially toward the cylindrical walls of the housing cylinder, the vortices also extend to the walls. The finely mixed bleaching chemicals and pulp are then forced by rotating radial vanes through a foraminous cylinder which separates the interior of the cylindrical housing from an outlet volute. The radial vanes extend to near engagement with the foraminous cylinder. The foraminous cylinder has a porosity of about ten percent, and the holes formed in the foraminous cylinder are fairly large—on the order of one inch. The shear produced by the radial vanes extending to near engagement with the foraminous cylinder fluidizes the pulp and completely mixes the bleach chemicals and the pulp.

It is a feature of the present invention to provide a medium consistency paper pulp mixer which requires less energy.

It is another feature of the present invention to provide a medium consistency paper pulp mixer which achieves better mixing between the paper pulp and a chemical flow.

It is a further feature of the present invention to provide a medium consistency paper pulp mixer which can mix over two thousand tons of paper pulp a day.

It is also a feature of the present invention to provide a means for distributing a first liquid in a medium consistency pulp stock.

It is an additional feature of the present invention to provide a new means for fluidizing paper pulp stock containing about twelve percent paper fibers by weight.

Further objects, features and advantages of the invention will be apparent from the following detailed description when taken in conjunction with the accompanying drawings.

DESCRIPTION OF THE PREFERRED EMBODIMENT

Figure 1:
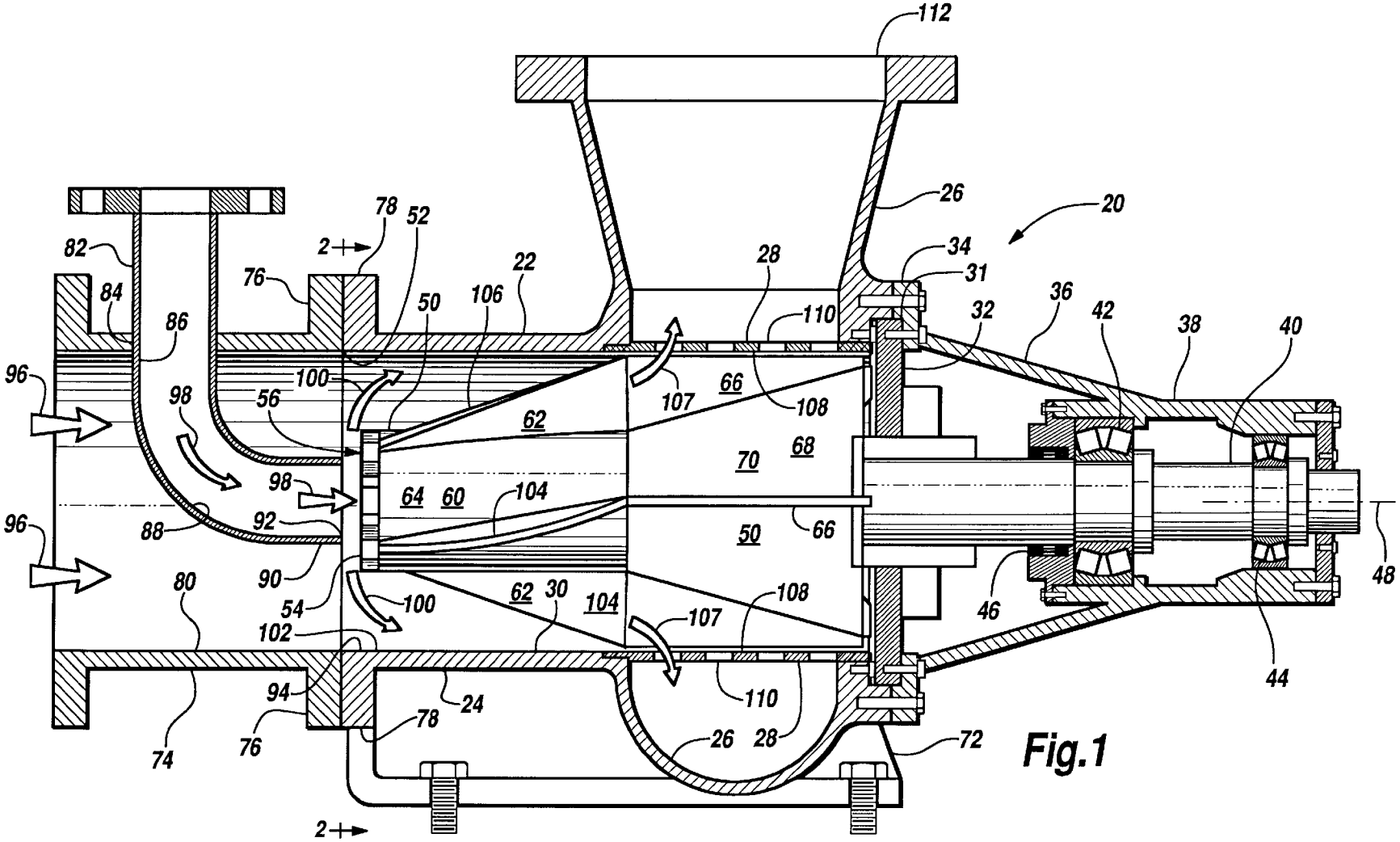
FIG. 1 is a side elevational view, partly cut away in section, of the medium consistency paper pulp mixer of this invention.
Figure 2:
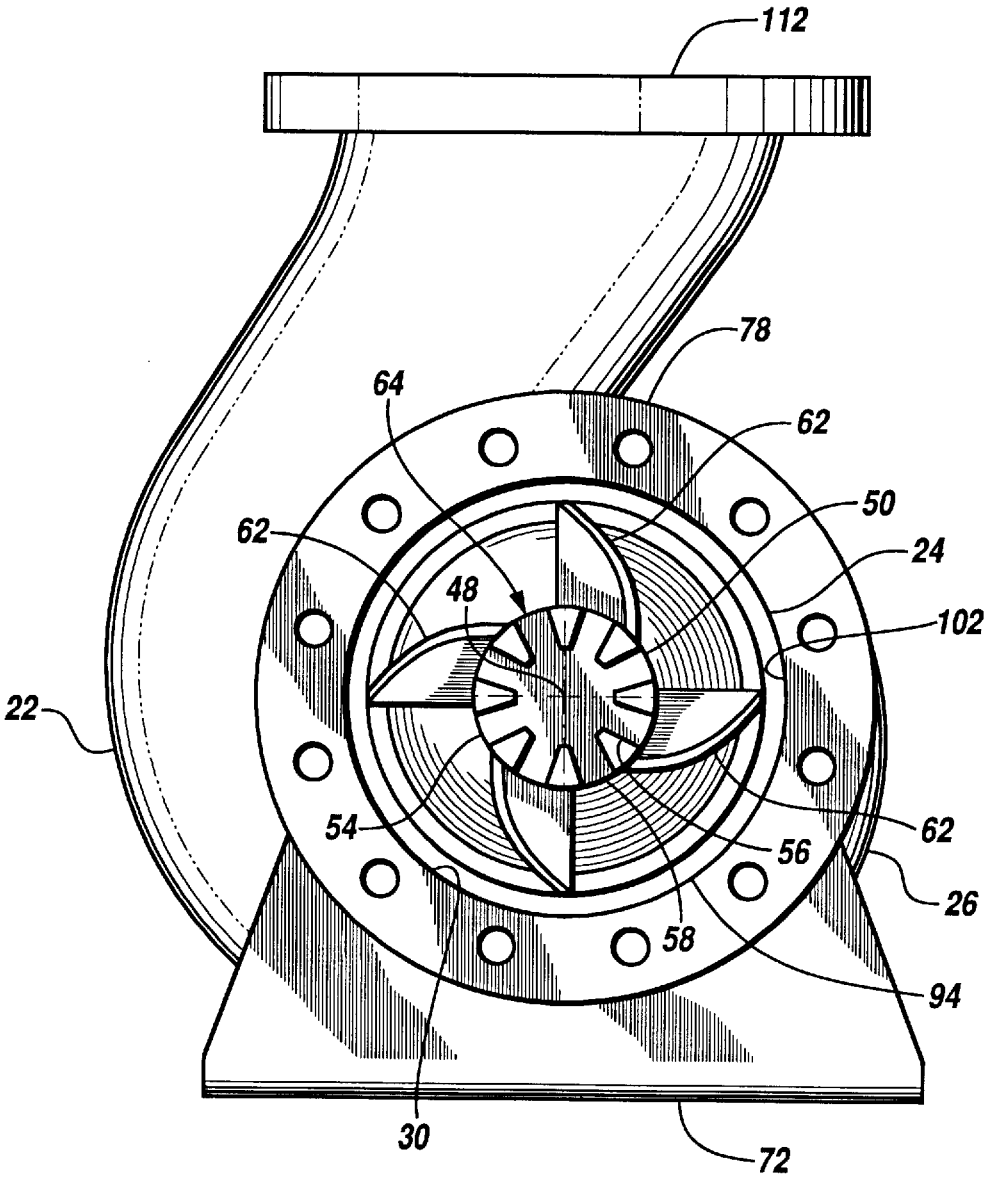
FIG. 2 is a cross-sectional view of the paper pulp mixer of FIG. 1 taken along section line 2—2.
Figure 3:
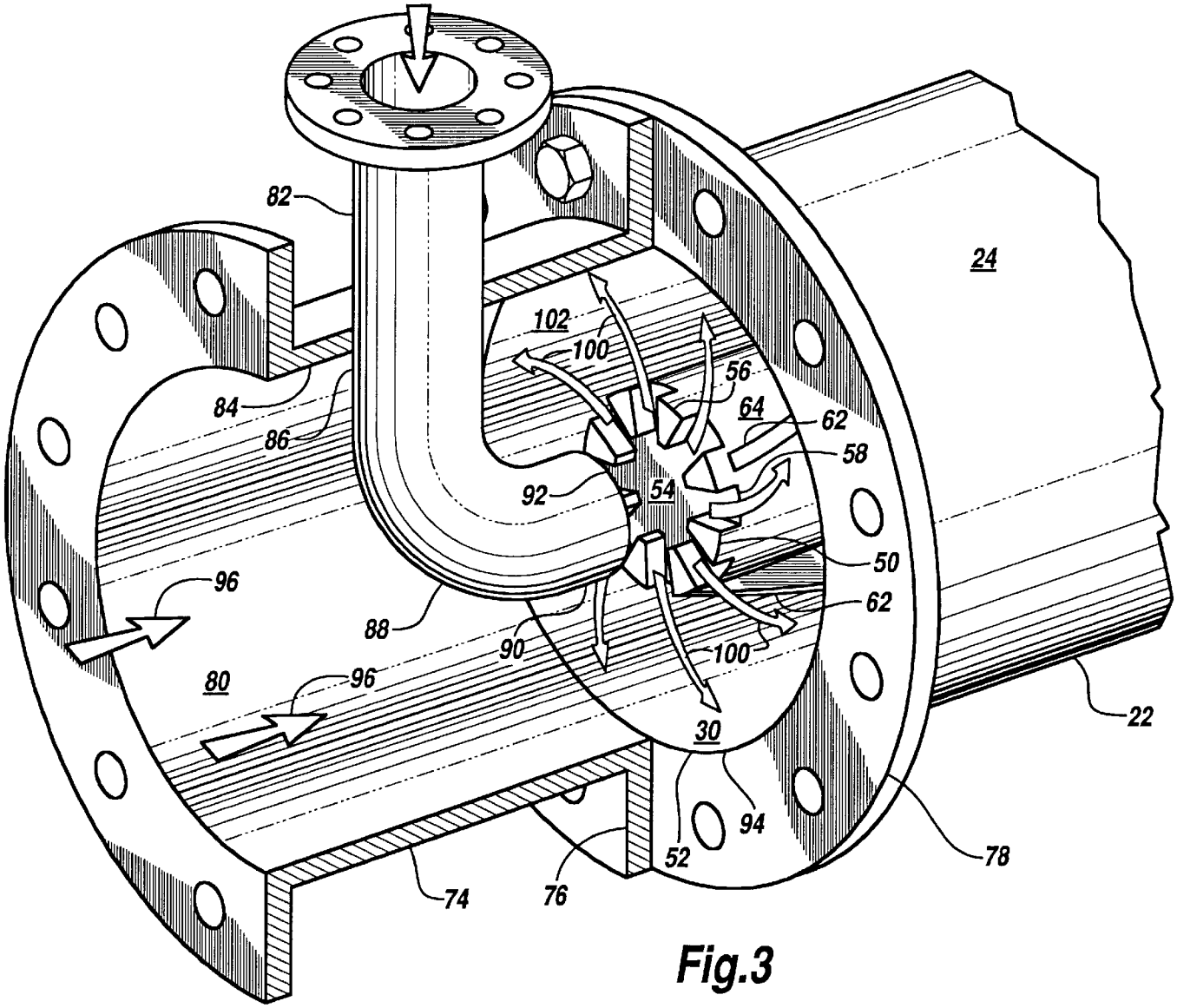
FIG. 3 is an isometric view, partly cut away in section, showing the chemical inlet and the rotor of the medium consistency paper pulp mixer of FIG. 1.

Referring more particularly to FIGS. 1–3 wherein like numbers refer to similar parts, a mixer 20 is shown in FIG. 1. The mixer 20 has a housing 22 consisting of a cylindrical section 24 joined to a volute 26. A foraminous cylinder 28 is co-extensive with the cylindrical section 24 and separates the interior 30 of the housing 22 from the volute 26. A first end 31 of the housing is terminated by a plate 32. An annular ring 34 is bolted to the housing 22 and the end plate 32. The annular ring 34 adjoins a conical housing section 36 which in turn supports a cylindrical bearing housing 38. A shaft 40 is supported on first bearings 42 and second bearings 44 which are mounted to the cylindrical bearing housing 38. The bearing housing 38 supports a shaft seal 46. The shaft 40 extends along the axis 48 of the housing 22 and extends through the plate 32 into the interior 30 of the housing 22. The shaft supports a rotor 50 which extends from the plate 32 to within a short distance of the end 52 of the cylindrical section 24.

The rotor 50 has three distinct sections: a head 54 which terminates the rotor 50; a cylindrical section 26 with tapered spiral vanes 62; and a frustoconical third section 70 with radial vanes 66. As shown in FIGS. 2 and 3, the head 54 has a radially extending surface 56 with radially extending grooves 58 formed in the head surface 56. The second section 60 is cylindrical and extends from the head 54 to frustoconical third section 68. Four tapered vanes 62 extend from the cylindrical surface 64 of the second section 60. The vanes 62 join the radial vanes 66 which extend from the conical surface 68 of the rotor third section 70.

As shown in FIG. 1, the housing 22 has a base 72 for mounting the mixer 20 to a foundation (not shown). A cylindrical fluid injection pipe section 74 is joined by a flange 76 to a flange 78 which terminates the cylindrical section 24 of the housing 22. The injection pipe section 74 has a cylindrical section 80 which is coextensive with the cylindrical section 24 of the housing 22. The medium density fluid is introduced to the cylindrical section 24 of the housing through the injection pipe section. A conduit for the injection of the additive fluid is provided by curved injection tube 82 which penetrates the cylindrical wall 84 of the injection section 74 and discharges at the rotor head 54. The injection tube 82 has an inlet portion 86 which extends radially inwardly of the wall 84 and a curved portion 88 which joins an axially extending discharge portion 90 through which fluid is discharged through an opening 92 which faces the head 54 of the rotor 50 and is axially aligned with the axis 48 of the shaft 40 and rotor 50.

Medium consistency paper pulp stock consisting of about twelve percent paper fibers by weight is supplied to the mixer 20 through the cylindrical section 80 of the fluid injection pipe 74. The inlet 94 of the housing cylindrical section 24 has a diameter of about ten inches and is designed to accommodate a flow of approximately one thousand tons of pulp a day. The pulp travels through the injection pipe 74 at between five and ten feet per second. The pulp, indicated by arrows 96, has a high viscosity as it approaches the mixer housing 22 because of the relatively low shear which the stock is exposed to during flow in the pipe section 74.

A flow (indicated by arrows 98) of bleach chemicals is injected through the injection tube 82 along the axis 48 to impinge on the head 54 of the rotor 50. The bleach chemicals are typically either chlorine dioxide, or hydrogen peroxide, in a water solution, the solution amounting to approximately twenty-five percent of the volumetric flow of paper pulp stock. As the shaft 40 is rotated, the grooves 58 in the surface 56 of the head 54 act as a centrifugal pump. As shown in FIG. 3, the grooves 58 generate streams of bleach chemicals indicated by arrows 100 which stream radially outward from the head 50 towards the inwardly facing surface 102 of the cylindrical section 24 of the housing 22. The bleach chemical streams 100 will ideally extend completely across the radial dimension of the flow of pulp indicated by arrows 96.

The rotor is driven by a fifty horsepower motor (not shown) which is coupled directly to the shaft 40. By design of the motor, the rotational speed of the motor and shaft can be selected to be either 1,200 or 1,800 rpm if 60 Hz line frequency is used, or 1,000 rpm or 1,500 rpm if 50 Hz line frequency is used.

As the pulp flow 96 moves through the cylindrical section 24 of the housing 22 between the outwardly facing cylindrical surface 64 of the rotor 50 and the inwardly facing surface 102 of the cylindrical section 24, the vanes 62, which do not extend all the way to the housing walls, set up a turbulent recirculation. The rotating vanes 62 act against the flow 96 causing the pulp and bleach chemicals to flow out radially along the leading surfaces 104 of the vanes 62. When the pulp and bleach chemicals reach the ends 106 of the vanes 62, the pulp and bleach chemicals flow over the vane ends. As the vanes 62 approach the surface 102 of the cylindrical section 24, there is not room for the flow to pass over the ends 106 of the vanes 62 with the result that the recirculation of the pulp stock and bleach chemicals is contained between the vanes 62.

The tapering of the vanes 62 is not essential, most important is that the vanes do not extend all the way to the surface 102 of the cylindrical section 24. Tapering the vanes 62 is, however, useful to insure recirculation of the pulp and to insure that the bleaching chemicals extend all the way across cylindrical section 24 in the radial direction.

The pulp and bleach chemicals mix in a flow indicated by arrows 107. At the third section 70 of the rotor 50 the conical surface 68 forms a plenum which insures an even flow of pulp across the foraminous cylinder 28. The radial vanes 66 cause a region of high shear over the inside surface 108 of the foraminous cylinder 28. The large openings 110 through the foraminous cylinder 28 allow the ready passage of the mixed stock through the foraminous cylinder 28. The openings 110 are approximately one inch in diameter. The percentage of the foraminous cylinder 28 which is occupied by holes 110 can vary from about five percent to about forty percent of the surface 108 of the cylinder 28. Too little open area impedes the flow of stock through the foraminous cylinder 28; too much open area may not produce shear at the inner surface 108. A reasonable value for open area may be about ten percent.

The vanes 62 are shown in FIGS. 1–3 set with a slightly helical position to either assist the motion of the pulp in the direction of pulp flow or to oppose the direction of pulp flow depending on the direction of rotation of the shaft 40. If the vanes 62 assist motion of the pulp, they help to reduce the pressure drop through the mixer 20. On the other hand, if the vanes 62 move so as to oppose the direction of motion of the pulp, they increase the amount of recirculation.

The operation of the portion of the pulp mixer 20 before the pulp is subjected to high shear, can be roughly analogized to the process of making puff pastry or cinnamon rolls. The effect of the grooves 58 in the head 54 dispersing the bleaching chemicals along the streams 100 may be compared to the way in which filling is sandwiched between two layers of pastry dough, and the pastry dough with the included filling is then folded in half and refolded until hundreds of layers of dough and filling are created. This is analogous to the mixing that takes place in the cylindrical section 24 between the cylindrical rotor surface 64 and the cylindrical wall surface 102. The object in making puff pastry or cinnamon rolls is to evenly distribute the filling throughout the dough without mixing the dough and filling together. With the pulp mixer 20, however, it is desirable to intimately mix the pulp and chemical bleaching solution together. This is accomplished by the fluidizing zones produced by the high shear forces between the rotor vanes 66 and the foraminous cylinder 28. Because of the premixing where the bleaching solution and the pulp stock are folded together, the fluidizing zones can be very small and still evenly mix the stock and bleach together.

Because the fluidizing zone is smaller than in conventional mixers, the energy usage of the mixer 20 can be reduced.

It should be understood that the mixing function of the mixer 20 and the fluidizing function of the mixer have independent utility and might be used in separate machines. On the other hand, the combination of the premixing with the use of a foraminous cylinder and vanes to create a fluidizing region synergistically produces an apparatus which achieves better mixing with less power consumption.

The vanes 66 not only create a pumping action and a fluidizing shear region, but also create a negative pressure pulse as they pass over the inside surface 102 of the cylindrical section 24. The negative pressure pulse serves to prevent clogging of the openings 110 in the foraminous is cylindrical section 28.

It should be understood that medium consistency paper pulp stock is understood by those skilled in the art of papermaking to be pulp stock having approximately the maximum fiber content which can readily be pumped which is typically about twelve percent fiber by weight and about twenty percent fiber by volume. However, pulp stocks referred to as medium consistency may have from about five percent to about eighteen percent fiber by weight. Furthermore, the volume of the chemical solution being mixed with the pulp can vary from about one percent to over twenty-five percent. The design of the rotor head grooves will vary with the percentage of solution being mixed with the pulp stock. The total cross-sectional area of the grooves being proportional to the amount of fluid which they must accelerate and distribute throughout the body of the stock flowing through the mixer.

It will also be understood by those skilled in the art of papermaking that the outlet 112 of the mixer will typically be connected to a reaction tower which may have a height of two hundred feet or more. The reaction tower is sized to give the bleaching chemicals time to react with the pulp fibers. The consequence of the bleaching tower is that the stock on leaving the mixer must have a pressure sufficient to move the stock through the height of the tower. For a tower of two hundred feet, the pressure of the stock leaving the mixer must be at least equal to the static head of the reaction tower. A typical number for the pressure of the pulp entering and exiting the mixer might be about one hundred pounds per square inch if the mixer feeds a reaction tower of two hundred feet.

It will also be understood that mixers of various sizes can be produced. Useful size ranges are anticipated to be from about three hundred to about twenty-five hundred tons per day throughput.

It should be understood although the bleach chemicals are shown being injected through a curved pipe into a flow of pulp along a straight pipe, the flow of bleach chemicals could be injected through a straight pipe coaxial with the rotor, which penetrates a pulp supply pipe which is curved.

It is understood that the invention is not limited to the particular construction and arrangement of parts herein illustrated and described, but embraces such modified forms thereof as come within the scope of the following claims.

We claim:

1. An apparatus for mixing a liquid with a medium consistency pulp stock; the apparatus comprising:

a housing having a substantially cylindrical section which defines a housing axis, the housing having an open end adjacent to the cylindrical section for receiving a flow of medium consistency paper pulp stock;

a shaft extending along the housing axis and mounted for rotation to the housing;

a rotor mounted to the shaft and along the housing axis, the rotor having an unsupported end terminating in a head having a radially extending surface, the rotor having a first portion which extends along the housing axis inside the cylindrical section;

a pipe having an outlet opposite the head radially extending surface to direct a stream of liquid onto the radially extending surface;

a plurality of radially extending first vanes mounted to the first rotor portion, wherein when pulp stock is flowing through the cylindrical section and a stream of liquid is impinged on the radially extending surface the liquid is dispersed in the pulp stock and the radially extending first vanes mix the liquid and pulp stock together, and wherein the first vanes are tapered so as to slope towards an inner surface defined by the cylindrical portion of the housing as the vanes extend away from the head of the rotor.

2. The apparatus of claim 1 wherein the head has radially extending grooves formed on the radially extending surface defined by the head, wherein the grooves receive and disperse a liquid throughout a flow of medium consistency paper pulp stock.

3. The apparatus of claim 1 wherein the radially extending first vanes have at least portions which are substantially spaced from the cylindrical section of the housing so as to allow flow between the vanes and the housing.

4. The apparatus of claim 1 wherein the first vanes helically wrap about the rotor.

5. An apparatus for mixing a liquid with a medium consistency pulp stock; the apparatus comprising:

a housing having a substantially cylindrical section which defines a housing axis, the housing having an open end adjacent to the cylindrical section for receiving a flow of medium consistency paper pulp stock;

a shaft extending along the housing axis and mounted for rotation to the housing;

a rotor mounted to the shaft and along the housing axis the rotor having an unsupported end terminating in a head having a radially extending surface, the rotor having a first portion which extends along the housing axis inside the cylindrical section;

a pipe having an outlet opposite the head radially extending surface to direct a stream of liquid onto the radially extending surface;

a plurality of radially extending first vanes mounted to the first rotor portion, wherein when pulp stock is flowing through the cylindrical section and a stream of liquid is impinged on the radially extending surface the liquid is dispersed in the pulp stock and the radially extending first vanes mix the liquid and pulp stock together further comprising:

a foraminous cylinder having an interior surface and being coaxial with the housing cylindrical section and adjoining the housing cylindrical section opposite the housing open end;

a second portion of the rotor which extends along the housing axis and which is spaced radially inwardly from the foraminous cylinder;

a plurality of radially extending second vanes mounted on the rotor second portion, the second vanes being closely spaced from the inner surface of the foraminous cylinder to generate a region of high shear in a flow of medium consistency paper pulp stock flowing from the open end and along the cylindrical section and through the foraminous cylindrical surface.

6. The apparatus of claim 5 further comprising a volute surrounding the foraminous cylinder and communicating with a pulp outlet.

7. The apparatus of claim 5 wherein the foraminous cylinder has portions defining radially extending holes about one inch in diameter.

8. The apparatus of claim 5 wherein the second portion of the rotor has a frustoconical shape which increases in diameter as it extends away from the rotor head.

9. The apparatus of claim 5 wherein the proportion of open area to total area of the foraminous cylinder is between five and forty percent.

10. The apparatus of claim 5 wherein the foraminous cylinder has a proportion of open area to total area of the foraminous cylinder which is about ten percent.

11. An apparatus for mixing a liquid with a medium consistency pulp stock comprising:

a housing having a substantially cylindrical section which defines a housing axis, wherein the housing has an open end adjacent to the cylindrical section for receiving a flow of medium consistency paper pulp stock;

a foraminous cylinder having an interior surface and being coaxial with the housing cylindrical section and adjoining the housing cylindrical section opposite the open end;

a shaft extending along the housing axis and mounted to the housing for rotation;

a rotor mounted on and coaxial with the shaft;

a plurality of radially extending vanes mounted on a portion of the rotor which extends along the housing axis and radially inward of the foraminous cylinder, the vanes being closely spaced to the interior surface of the foraminous cylinder so as to generate a region of high shear in a flow of medium consistency paper pulp stock flowing from the open end and along the cylindrical section and through the foraminous cylinder surface; and a volute surrounding the foraminous cylinder and communicating with a pulp outlet.

12. The apparatus of claim 11 wherein the foraminous cylinder has portions defining radially extending holes of about one inch in diameter.

13. The apparatus of claim 11 wherein the proportion of open area to total area of the foraminous cylinder is between five and forty percent.

14. The apparatus of claim 11 wherein the foraminous cylinder has a proportion of open area to total area of the foraminous cylinder which is about ten percent.

15. An apparatus for mixing a liquid with a medium consistency pulp stock comprising:

a housing having a substantially cylindrical section which defines a housing axis, wherein the housing has an open end adjacent to the cylindrical section for receiving a flow of medium consistency paper pulp stock;

a foraminous cylinder having an interior surface and being coaxial with the housing cylindrical section and adjoining the housing cylindrical section opposite the open end;

a shaft extending along the housing axis and mounted to the housing for rotation;

a rotor mounted on and coaxial with the shaft;

a plurality of radially extending vanes mounted on a first portion of the rotor which extends along the housing axis and radially inward of the foraminous cylinder, the vanes being closely spaced to the interior surface of the foraminous cylinder so as to generate a region of high shear in a flow of medium consistency paper pulp stock flowing from the open end and along the cylindrical section and through the foraminous cylinder surface;

wherein the rotor terminates in a head defining a radially extending surface, the apparatus further comprising;

a pipe having an outlet opposite the radially extending surface for directing a stream of liquid onto the radially extending surface;

a second plurality of radially extending vanes mounted on a second portion of the rotor which extends along the axis of the cylindrical section the second portion being between the first portion of the rotor and the radially extending surface.

16. The apparatus of claim 15 wherein the second radially extending vanes mounted on the second portion of the rotor which extends along the axis of the cylindrical section have at least portions which are substantially spaced from the cylindrical section of the housing so as to allow flow between the vanes and the housing.

17. The apparatus of claim 16 wherein the second radially extending vanes are helically wrapped about the rotor.

18. The apparatus of claim 16 wherein the second radially extending vanes are tapered so as to slope towards an inner surface defined by the cylindrical portion of the housing as the vanes extend away from the head defining a radially extending surface.

19. An apparatus for mixing a liquid with a medium consistency pulp stock comprising:

a housing having a substantially cylindrical section which defines a housing axis, wherein the housing has an open end adjacent to the cylindrical section for receiving a flow of medium consistency paper pulp stock;

a foraminous cylinder having an interior surface and being coaxial with the housing cylindrical section and adjoining the housing cylindrical section opposite the open end;

a shaft extending along the housing axis and mounted to the housing for rotation;

a rotor mounted on and coaxial with the shaft; and a plurality of radially extending vanes mounted on a portion of the rotor which extends along the housing axis and radially inward of the foraminous cylinder, the vanes being closely spaced to the interior surface of the foraminous cylinder so as to generate a region of high shear in a flow of medium consistency paper pulp stock flowing from the open end and along the cylindrical section and through the foraminous cylinder surface, wherein the portion of the rotor which extends along the housing axis and along the foraminous cylinder has a frustoconical shape which increases in diameter away from the open end of the housing.

20. An apparatus for mixing a liquid with a medium consistency pulp stock; the apparatus comprising:

a housing having portions defining a substantially cylindrical chamber with a housing axis;

a pipe section which discharges medium consistency pulp stock into the housing cylindrical chamber along the housing axis;

a rotor positioned within the cylindrical chamber and extending along the housing axis and rotatable about the housing axis;

portions of the rotor defining a head which has surfaces which extend substantially perpendicular to the housing axis;

a pipe which discharges a liquid in the direction of the housing axis toward the rotor head, where the discharged liquid is dispersed radially by the rotating rotor head to form a mixture of liquid and pulp stock;

a plurality of radially extending vanes mounted on the rotor;

portions of the housing which define an outlet downstream of the rotor head; and a screen positioned over the outlet, such that the mixture of liquid and pulp stock passes through the screen on leaving the cylindrical chamber and is further mixed thereby.

21. The apparatus of claim 20 wherein portions of the head define radially extending grooves which receive and disperse the liquid throughout a flow of medium consistency pulp stock.

22. The apparatus of claim 20 wherein the rotor has a first section which is substantially cylindrical, and a second section which is substantially frustoconical, the second section being positioned downstream of the first section, and wherein the radially extending vanes are positioned on both the first section and the second section.

23. The apparatus of claim 22 wherein first vanes extend helically about the rotor first section, and second vanes are positioned on the rotor second section which extend exclusively radially, the second varies being continuous with the first vanes.

24. The apparatus of claim 22 wherein the vanes extend so as to be closely spaced from the screen and to generate a region of high shear in the flow of mixed liquid and medium consistency paper pulp stock.

25. The apparatus of claim 20 wherein the screen comprises a cylindrical member with a plurality of openings formed therein.

26. The apparatus of claim 25 wherein the proportion of open area to total area of the screen is between five and forty percent.

27. The apparatus of claim 25 wherein the foraminous cylinder has a proportion of open area to total area of the foraminous cylinder which is about ten percent.

28. The apparatus of claim 20 further comprising a volute surrounding the screen.

* * * * *